US007055528B2

(12) United States Patent
Shah et al.

(10) Patent No.: US 7,055,528 B2
(45) Date of Patent: Jun. 6, 2006

(54) APPLICATOR

(75) Inventors: Manzoor A. Shah, Boston, MA (US); Pablo Valdivia Y Alvarado, Cambridge, MA (US); Kamal Youcef-Toumi, Cambridge, MA (US)

(73) Assignee: Alpine Pharmaceuticals, Cambridge, MA (US)

( * ) Notice: Subject to any disclaimer, the term of this patent is extended or adjusted under 35 U.S.C. 154(b) by 52 days.

(21) Appl. No.: 10/401,182

(22) Filed: Mar. 27, 2003

(65) Prior Publication Data

US 2004/0187883 A1 Sep. 30, 2004

(51) Int. Cl.
*A45D 24/16* (2006.01)
*A45D 24/22* (2006.01)
*A45D 24/00* (2006.01)

(52) U.S. Cl. ..... 132/109; 132/114; 132/147

(58) Field of Classification Search ..... 132/108, 132/109, 112, 113, 114, 147; 433/80; 401/270, 401/282, 289, 188 R; 222/144.5, 134–137, 222/333, 192
See application file for complete search history.

(56) References Cited

U.S. PATENT DOCUMENTS 3,386,621 A * 6/1968 Arps et al. ..... 222/30
3,688,947 A * 9/1972 Reichenberger ..... 222/27
3,713,774 A * 1/1973 Southwick ..... 422/100
3,777,937 A * 12/1973 Buck ..... 222/641
4,282,987 A * 8/1981 Thomas et al. ..... 222/641
4,292,986 A 10/1981 Ergaver et al. ..... 132/11 R
4,765,509 A * 8/1988 Eisenhut et al. ..... 222/61
4,867,183 A 9/1989 Busch et al. ..... 132/110
5,054,504 A 10/1991 Winrow
5,152,305 A 10/1992 Niv ..... 132/112
5,289,835 A * 3/1994 Harlan et al. ..... 132/313
5,343,881 A 9/1994 Golan et al. ..... 132/119.1
5,454,131 A 10/1995 Mackenzie ..... 15/104.92
5,483,719 A 1/1996 Ikemoto et al. ..... 15/104.94
5,485,646 A 1/1996 Merritt ..... 15/105
5,524,648 A 6/1996 Colon et al. ..... 132/120
D374,741 S 10/1996 Devereaux ..... D28/7
5,600,865 A 2/1997 Morrison ..... 15/169
5,746,531 A 5/1998 Izhak ..... 401/139
5,819,758 A 10/1998 Sohler ..... 132/121
5,845,651 A 12/1998 de Nervo ..... 132/114
5,927,290 A 7/1999 Thiruppathi ..... 132/116
5,937,866 A 8/1999 Magharehi ..... 132/116

(Continued)

*Primary Examiner*—Kevin Shaver
*Assistant Examiner*—Stephanie L. Willatt
(74) *Attorney, Agent, or Firm*—Iandiorio & Teska

(57) ABSTRACT

A dye applicator including a head with a cavity (reservoir) and a plurality of bristles in the form of pins each covered with a sponge sleeve extending into the cavity and moistened with a catalyzed dye in the cavity by capillary action. A handle is connected to the head and includes a first container for receiving a dye compound, a second container for receiving a catalyst compound, a pump for each container, and a mixing chamber with a threaded compartment connected to the head cavity on one end, connected to the first container on the other end, and connected to the second container by a manifold for distributing the catalyst throughout the threaded compartment of the mixing chamber. A solenoid is positioned to actuate both pumps to deliver the dye and the catalyst separately to the mixing chamber and to deliver the mixed catalyzed dye to the head cavity. A selector switch allows a task to be selected and a processor, responsive to the selector switch and having an output connected to the solenoid, is configured to control the number of solenoid cycles based on the position of the selector for precise application of the dye based on the task selected.

25 Claims, 10 Drawing Sheets

U.S. PATENT DOCUMENTS 6,006,395 A 12/1999 Tiramani et al. ..... 15/176.1
6,013,110 A 1/2000 Gee ..... 8/405
6,071,029 A 6/2000 Weinstock ..... 401/158
6,073,539 A * 6/2000 Triola et al. ..... 99/290
6,112,362 A 9/2000 Parko et al. ..... 15/169
D432,792 S 10/2000 Sivan ..... D4/136
6,145,513 A 11/2000 Chu et al. ..... 132/112
D439,051 S 3/2001 White ..... D4/102
D442,331 S 5/2001 Pannozzo et al. ..... D28/7
6,325,070 B1 12/2001 Tyroler et al. ..... 132/112
6,357,449 B1 3/2002 Chu et al. ..... 132/112
6,357,450 B1 3/2002 Paice ..... 132/114
6,421,872 B1 7/2002 Sciandivasci ..... 15/176.4
6,431,178 B1 8/2002 Usami et al. ..... 132/112
6,434,855 B1 8/2002 Miller ..... 34/96
6,506,374 B1 1/2003 Pollack ..... 424/70.6
6,513,534 B1 * 2/2003 Sofer et al. ..... 132/112

* cited by examiner

APPLICATOR

FIELD OF THE INVENTION

This invention relates to an applicator and, in one preferred embodiment, a brush-style applicator for applying dye to hair or a beard but also useful for applying other compounds such as soap, conditioner, or shampoo to the hair of humans and animals.

BACKGROUND OF THE INVENTION

Consumer hair coloring brushes have recently gained favor in the marketplace. One such brush, called the "Brush-N-Color" hair coloring brush available from IGIÀ, requires the consumer to pre-mix the dye with a developer catalyst, pour the mixture into the brush handle, and then manually pump the handle to deliver the dye to the hair. See also U.S. Pat. No. 6,357,449 and the many references cited therein.

The use of prior art hair coloring hairbrushes, however, can result in imprecise dye delivery to the hair or beard, a messy application process, and waste of dye. Also, forcing the consumer to mix the dye with a catalyst and to manually pump the mixture is not optimal or user friendly.

BRIEF SUMMARY OF THE INVENTION

It is therefore an object of this invention to provide an applicator which results in a more precise application of dye.

It is a further object of this invention to provide such an applicator which does not require the user to manually pump the dye.

It is a further object of this invention to provide such an applicator which automatically mixes the dye with a catalyst and eliminates the need for the consumer to pre-mix the dye with a catalyst.

It is a further object of this invention to provide such an applicator which results in less waste.

It is a further object of this invention to provide such an applicator which allows the user to select between tasks: long hair, short hair, beard, or mustache and whose mechanism uses only the required quantities of each compound for the chosen task.

It is a further object of this invention to provide such an applicator which is microprocessor controlled and battery powered.

It is a further object of this invention to provide such an applicator which is easy to clean.

It is a further object of this invention to provide such an applicator which can be used with a variety of different style brush or comb heads.

It is a further object of this invention to provide such an applicator which can be used in connection with compounds other than dyes, e.g., shampoos, conditioners, scalp treatments, and the like.

The invention results from the realization that a more precise, automatic, and less messy applicator is effected by the use of spongy sleeves covering the bristles of the brush. These are moistened with the dye by capillary action, since one end is always in contact with a dye or chamber "pool" resulting in a self-replenishing brush head. Precision is further effected by the inclusion of a selector mechanism for choosing between tasks (long hair, short hair, beard, mustache, etc.) connected to a processor which controls a solenoid to actuate the pumps of the dye and catalyst containers. Automatic mixing is effected by a unique mixing chamber between the dye and catalyst containers and the brush head.

In the preferred embodiment, this invention features a dye applicator comprising a head with a cavity and a plurality of bristles in the form of pins each covered with a sponge sleeve extending into the cavity and moistened with a catalyzed dye in the cavity by capillary action. A handle, connected to the head, includes a first container for receiving a dye compound, a second container for receiving a catalyst compound, a pump for each container, a mixing chamber with a threaded compartment connected to the head cavity on one end, connected to the first container on the other end, and connected to the second container by a manifold for distributing the catalyst throughout the threaded compartment. A solenoid is positioned to actuate both pumps to deliver the dye and the catalyst separately to the mixing chamber and to deliver the mixed catalyzed dye to the head cavity. There is a selector switch for selecting a task and a processor, responsive to the selector switch and having an output connected to the solenoid, configured to control the number of solenoid cycles based on the state of the selector for precise application of the dye based on the task selected.

In one example, the selector switch is on the handle and the first and second containers, the pumps, the mixing chamber, the solenoid, and the processor are all inside the handle. Preferably, there is also a power source for the solenoid and the processor such as a pair of batteries in a compartment in the handle.

Typically, the handle is round. One brush style head is substantially flat and includes an array of bristles extending from one surface thereof. Another comb style head is round and includes a single row of bristles. Still another brush style head is round and includes multiple spaced rows of bristles.

Preferably, a one way valve is on the handle for conveniently flushing the applicator. Also, the head is typically connected to the handle by a snap-fit mechanism or any other quick release mechanical junction to interchange different style heads with the same handle. In the preferred embodiment, the selector switch includes a potentiometer and a rolling knob for adjusting the voltage output by the potentiometer based on the position of the rolling knob.

One applicator in accordance with this invention features a head with a cavity and a plurality of bristles moistened with a substance in the cavity by capillary action. A handle, connected to the head, includes a selector mechanism for selecting a task, an actuator subsystem for delivering the substance to the cavity, and a processor responsive to the selector mechanism and having an output connected the actuator subsystem to control delivery of the substance to the head cavity based on the state of the selector mechanism.

An applicator in accordance with this invention may include a plurality of bristles moistened with a substance by capillary action, a selector mechanism for selecting a task, an actuator subsystem for delivering a substance to the bristles, and a control subsystem responsive to the selector mechanism and having an output connected to the actuator subsystem to control the delivery of the substance based on the state of the selector mechanism.

An applicator head in accordance with this invention features a housing with a reservoir for holding a compound, a plurality of pins extending outward from the housing, and a highly porous sleeve covering selected pins, the sleeve extending into the reservoir for transferring the compound out of the reservoir by capillary action. In the preferred embodiment, the sleeves are made of foam.

This invention also features a unique fluidic mixing and delivery subsystem for an applicator comprising a first container for receiving a dye compound, a second container for receiving a catalyst compound, a mixing chamber connected to the first and second containers, a pumping subsystem, an actuator which activates the pumping subsystem to deliver dye and the catalyst to the mixing chamber for mixing, and a processor configured to control the number of actuation cycles of the actuator. An applicator head with a reservoir therein is typically connected to the mixing chamber. The head preferably includes a plurality of highly porous members extending therein moistened with the mixed catalyzed dye by capillary action. A selector mechanism is typically included for selecting a task. A processor is connected to the selector mechanism to control the number of actuation cycles based on the state (e.g., position) of the selector mechanism. Preferably, the actuator is a solenoid, and the selector mechanism includes a potentiometer and a rolling knob for adjusting the voltage output by the potentiometer based on the position of the rolling knob. In one example, the pumping subsystem includes a separate pump, one for each container, both pumps activated simultaneously by the actuator.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
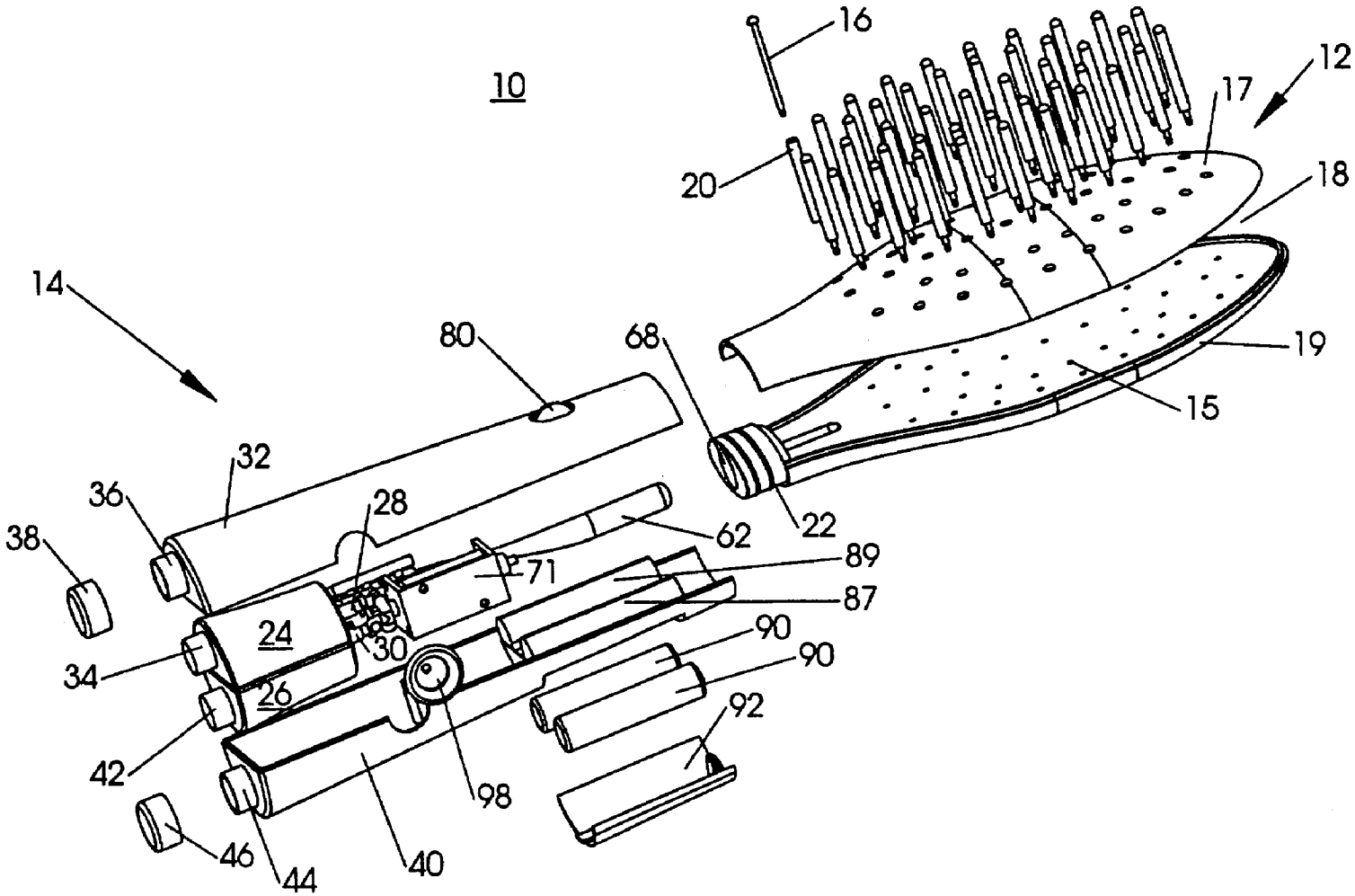
FIG. 1 is a schematic exploded three dimensional top view of one preferred embodiment of the dye applicator of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

Dye applicator 10, FIG. 1, in one preferred embodiment, includes head 12 and handle 14. Head 12 houses cavity or reservoir 18 and includes an array of bristles in the form of pins 16 which snap-fit in holes 15 each covered with a highly porous material, e.g., sponge sleeve 20. The distal end of each sponge sleeve extends into cavity 18 and in this way is moistened with a catalyzed dye by capillary action providing self-replenishment of the dye thereby reducing the risk of over application or mess. In the embodiment shown, head 12 is substantially flat and includes head sections 17 and 19 although other types of brush and comb heads can be used in connection with handle 14 of this invention as explained herein. Indeed, not every bristle need be a dye applicator bristle. Instead, some of the bristles could be conventional brush bristles.

In this embodiment, round handle 14 is connected to head 12 by a snap-fit via grooves 22 thus allowing the possibility of different style heads to be used with handle 14, however several other mechanical means of connection can be implemented between the handle and the heads, such as threading, etc. Handle 14, in one preferred embodiment, includes dye container 24 and catalyst container 26 each with its own pump 28 and 30. Dye container 24 is received in handle section 32 and nozzle 34 is concentrically disposed in handle nozzle 36 and covered by removable cap 38. Similarly, catalyst container 26 is received in handle section 40 and nozzle 42 of catalyst container 26 is concentrically disposed in handle nozzle 44 and covered by removable cap 46.

Figure 2:
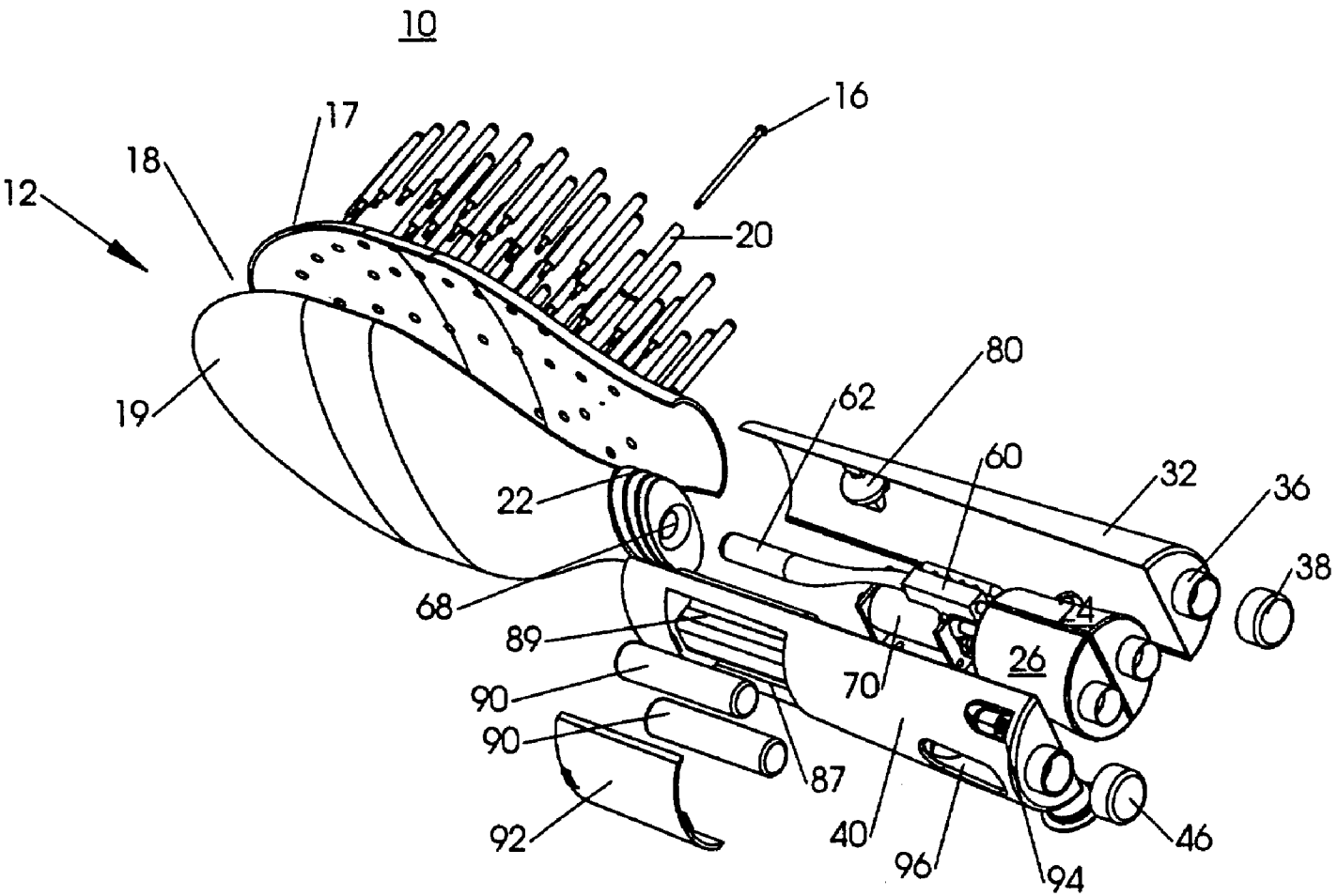
FIG. 2 is a schematic exploded three dimensional bottom view of the applicator shown in FIG. 1.

Mixing chamber 60, FIG. 2 has a threaded compartment connected to head cavity 18 via tube 62 on one end and connected to dye container 24 on the other end as explained herein. Tube 62 is received in opening 68 in head 12. A manifold associated with mixing chamber 60 is connected to catalyst container 26 for distributing catalyst throughout the threaded compartment of the mixing chamber.

An actuator such as solenoid 70, in the preferred embodiment, housed in bracket 71, FIG. 1 activates both pumps 28 and 30 to deliver the dye and the catalyst separately from dye container 24 and catalyst container 26 to mixing chamber 60 typically in equal ratios or other ratios and to deliver the mixed catalyzed dye from mixing chamber to head cavity 16. In other embodiments, however, the separate pumps can be replaced with a single pump or there could be a separate solenoid for each pump. Therefore, other types of fluid delivery subsystems are possible in accordance with the subject invention.

Selector mechanism 80, in the preferred embodiment, a potentiometer connected to a rolling knob on handle section 32, allows the user to select a task (e.g., long hair, short hair, beard, mustache, etc.). A processor is connected between selector mechanism 80 and solenoid 70. The processor is configured (i.e., programmed) to control the number of solenoid cycles based on the state of (e.g., position) of selector mechanism 80 for precise application of the dye based on task selected as explained below.

Batteries 90 in compartments 89 and 87 under handle cover 92 power solenoid 70 and the processor. It is also possible, however, to use dedicated circuitry in place of a processor and thus the use of the term "processor" herein includes control subsystems such as an appropriately programmed microprocessor or microcontroller and also integrated circuit components and application specific integrated circuits arranged and configured to drive solenoid 70 based on the position or state of selector mechanism 80. Adapter plug 94, FIG. 2 may also be provided for 110 volt operation when used in connection with a typical household adapter.

Window 96 allows the user to see how much product remains in container 26 in the example where container 26 (and/or container 24) is made of translucent material. Also, one way valve 98, FIG. 1 is conveniently provided for easy cleaning of applicator 10 when connected to a household faucet.

Figure 3:
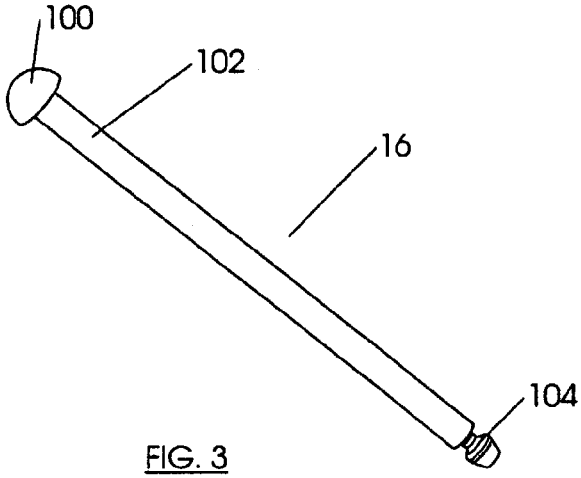
FIG. 3 is a schematic view of a bristle pin in accordance with the subject invention.
Figure 4:
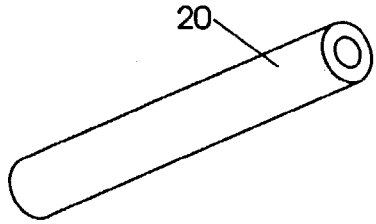
FIG. 4 is a schematic view of a sponge sleeve which surrounds the bristle pin shown in FIG. 3.
Figure 5:
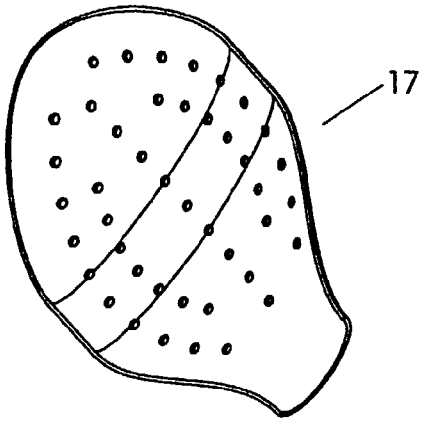
FIG. 5 is a schematic view of the top section of the brush head shown in FIGS. 1 and 2.
Figure 6:
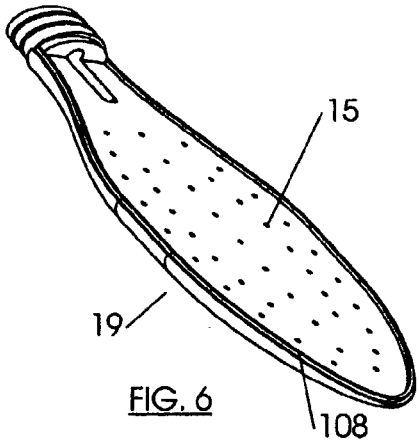
FIG. 6 is a schematic view showing the bottom section of the brush head shown in FIGS. 1 and 2.

FIG. 3 shows in more detail bristle pin 16 including round head 100, shaft 102, and grooved distal end 104 which snap fits into holes 15, FIG. 6 in bottom brush head section 19. FIG. 4 shows foam or sponge sleeve 20 which surrounds shaft 102 of pin 16. FIG. 6 shows in more detail lower head housing section 19 which is snap-fit to upper head section 17, FIG. 5 via groove 108.

Figure 7:
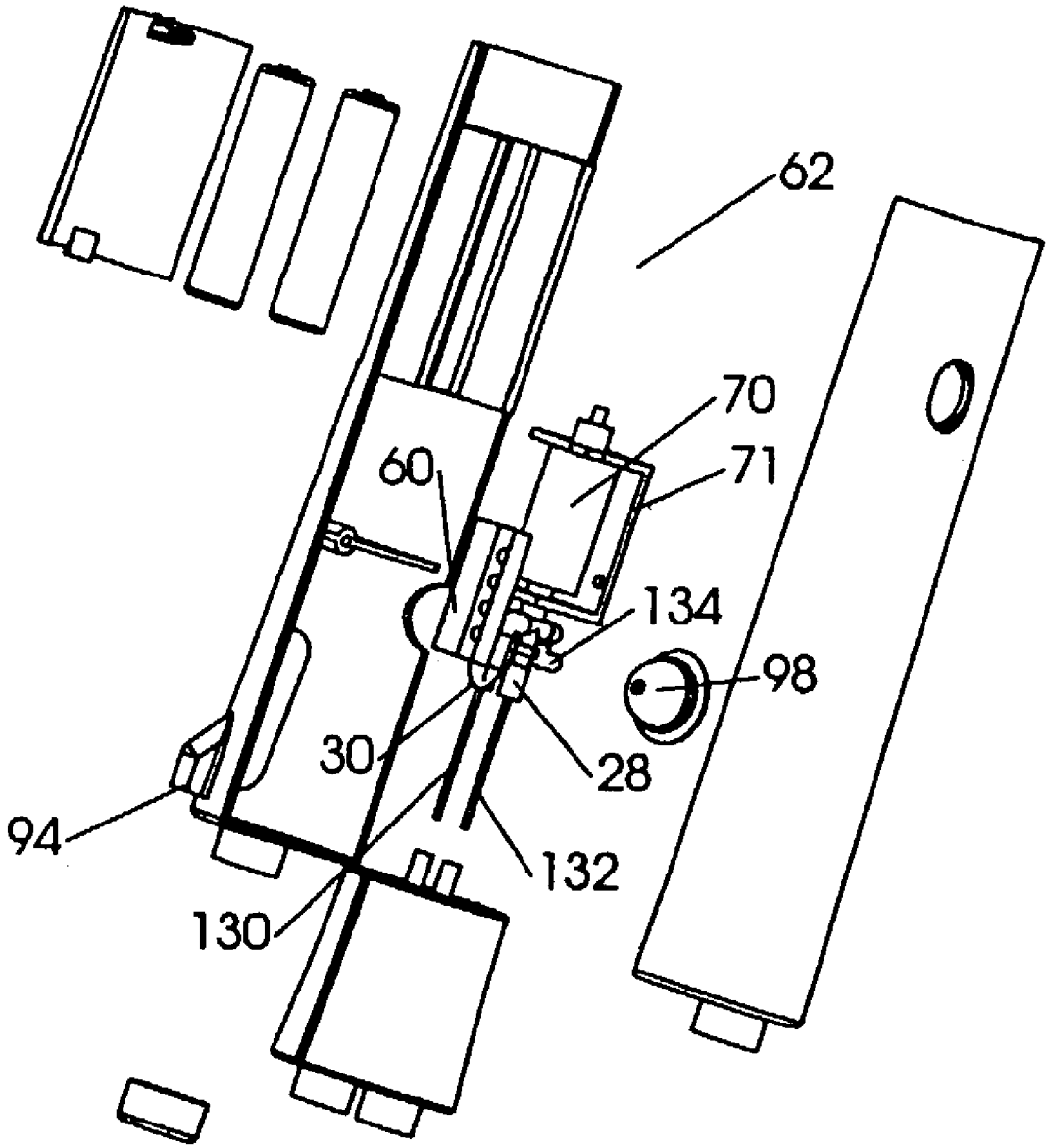
FIG. 7 is a schematic three dimensional exploded view showing the primary components associated with the brush handle in one preferred embodiment of the subject invention.

FIG. 7 shows in more detail how pumps 28 and 30 operate. Pumps 28 and 30 are similar to the manual pumps used on household type dispensers and each include a tube 130, 132 extending into a respective container. The heads of each pump are pushed by solenoid 70 to force fluid to mixing chamber 60 and ultimately, after mixing, to the head of the brush by tube 62. Tube 134 connects to one way valve 98 for cleaning as discussed above.

Figure 8:
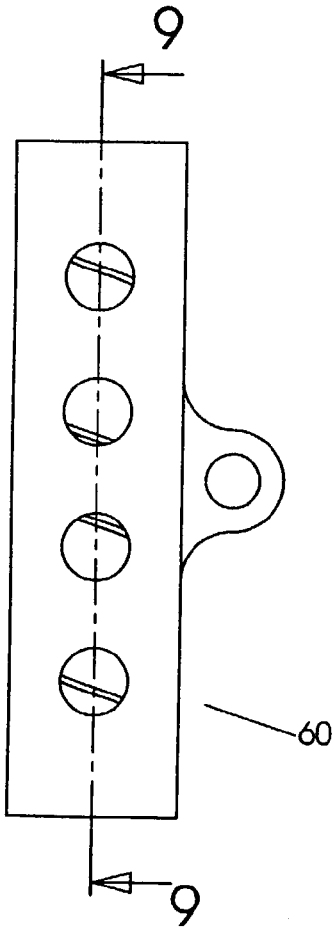
FIG. 8 is a top view of the mixing chamber of the subject invention.
Figure 9:
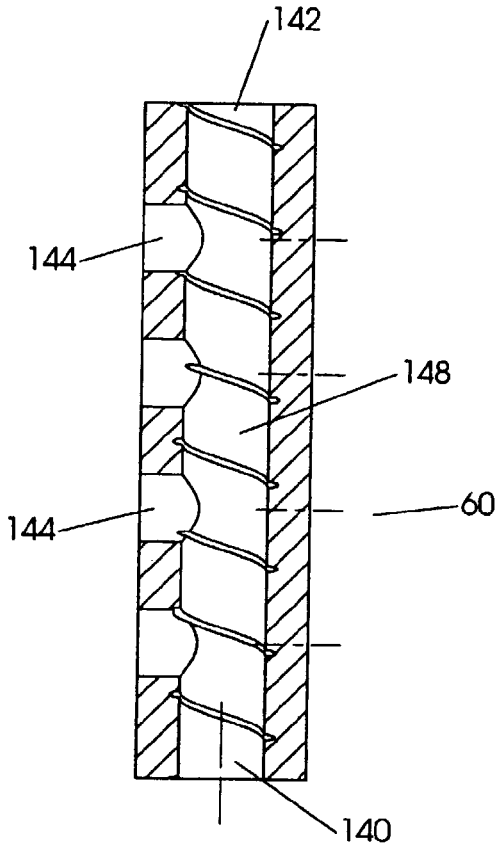
FIG. 9 is a schematic top sectional view taken along line 9—9 of FIG. 8.
Figure 10:
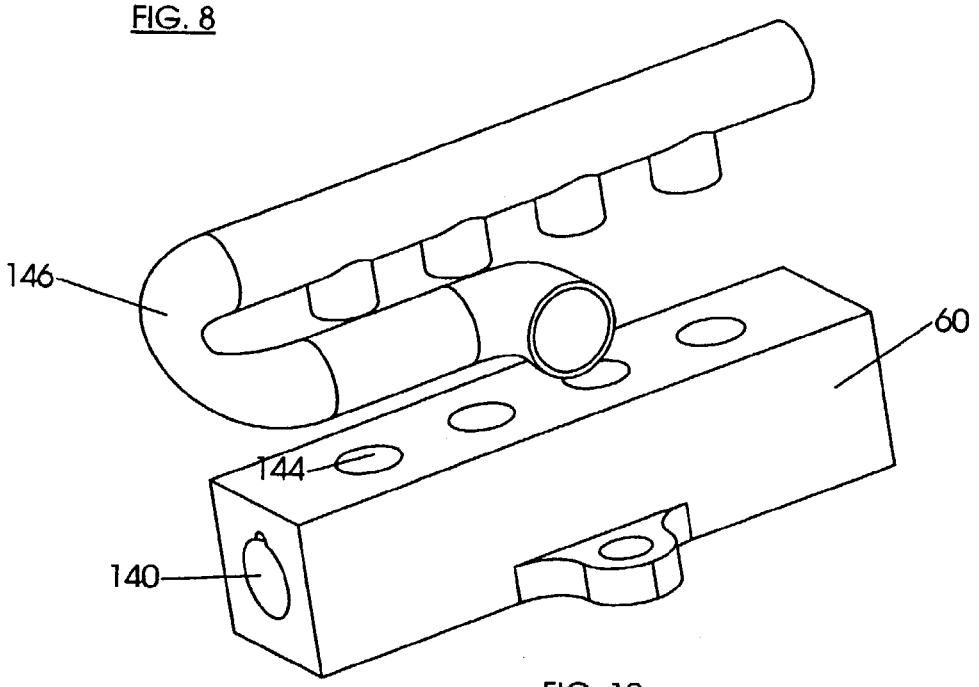
FIG. 10 is a schematic three dimensional view showing the mixing chamber and the manifold of the subject invention.

FIGS. 8–10 show mixing chamber 60 in more detail. Opening 140 receives dye from container 24, FIGS. 1–2 pumped by pump 28 and opening 142 connects to the head cavity of the brush via tube 62. Openings 144, FIGS. 8–10, receive catalyst from container 26, FIGS. 1–2 via manifold 146 which distributes the catalyst throughout threaded compartment 148, FIG. 9.

Figure 11:
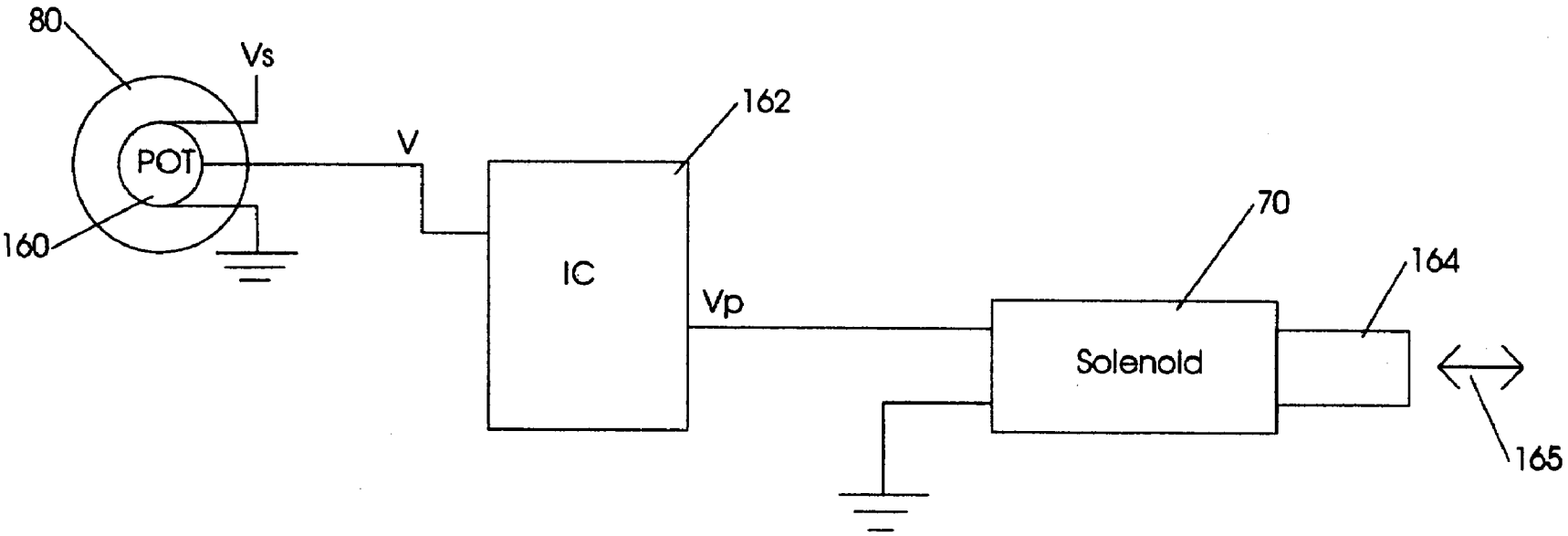
FIG. 11 is a block diagram showing the primary components associated with the fluid delivery control subsystem of the subject invention.

FIG. 11 shows selector switch potentiometer 160 connected to processor 162 which delivers an output to solenoid 70 to push the pump heads via member 164 which moves in the directions shown by arrow 165. As noted above, knob 80 is used to choose between task (long hair, short hair, beard, mustache, etc.) which changes the voltage supplied by potentiometer 160 to processor 162. Processor 162 is programmed to detect this change in voltage and to associate a particular voltage with a number of N cycles of solenoid 70. So, for example, if a "long hair" task is selected, processor 162 may activate solenoid 70 for N cycles. If, however, a "short hair" task is selected, processor 162 may activate solenoid 70 for 0.5N cycles. A beard task selection might result in 0.3N cycles, and conversely, a mustache task selection, perhaps 0.125N cycles. These numbers are exemplary only and those skilled in the art will know how to choose the number N and the different ratios of N depending upon the specific components selected for the applicator.

Figure 12:
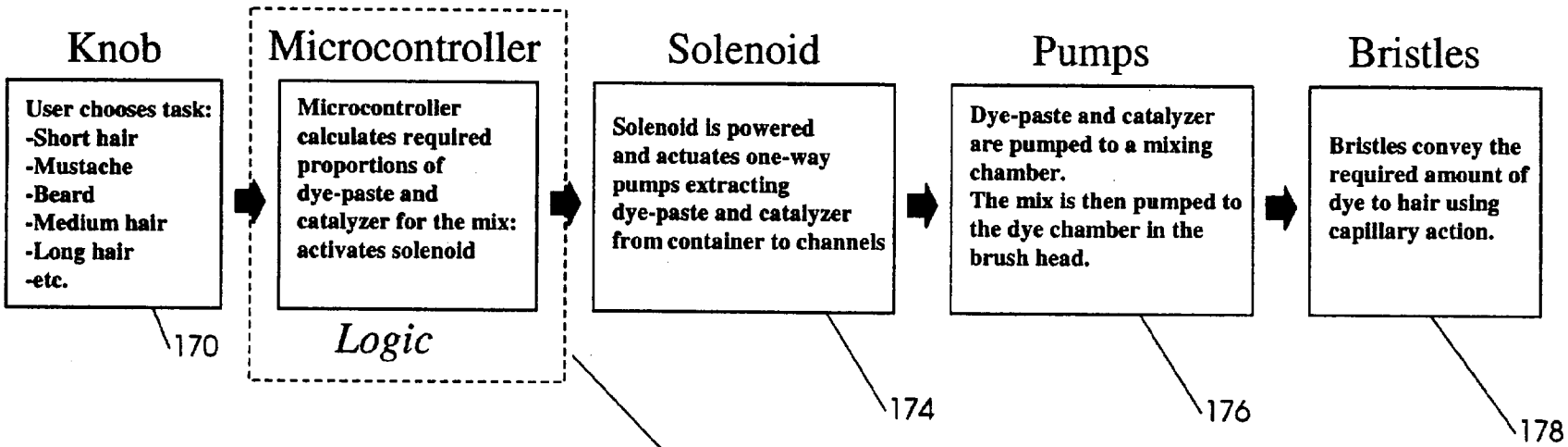
FIG. 12 is a flow chart depicting the primary steps associated with the operation of a dye applicator of the subject invention.
Figure 13:
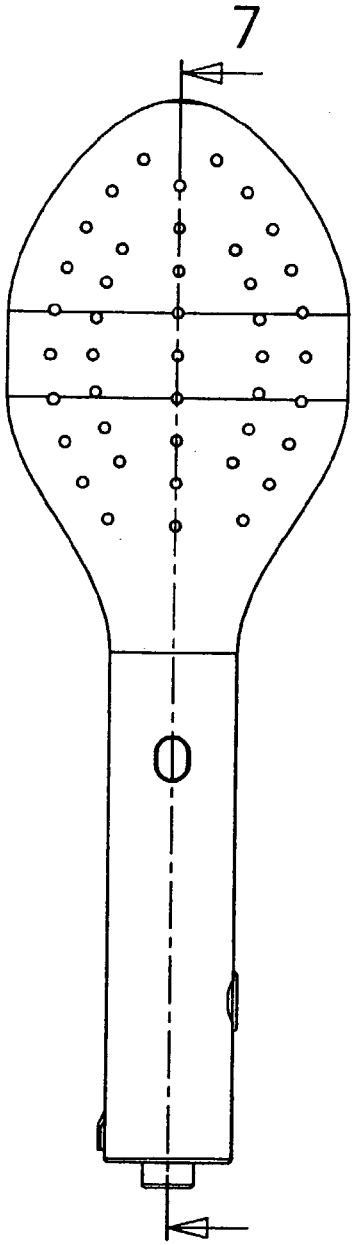
FIG. 13 is a view of a dye applicator in accordance with the subject invention.
Figure 14:
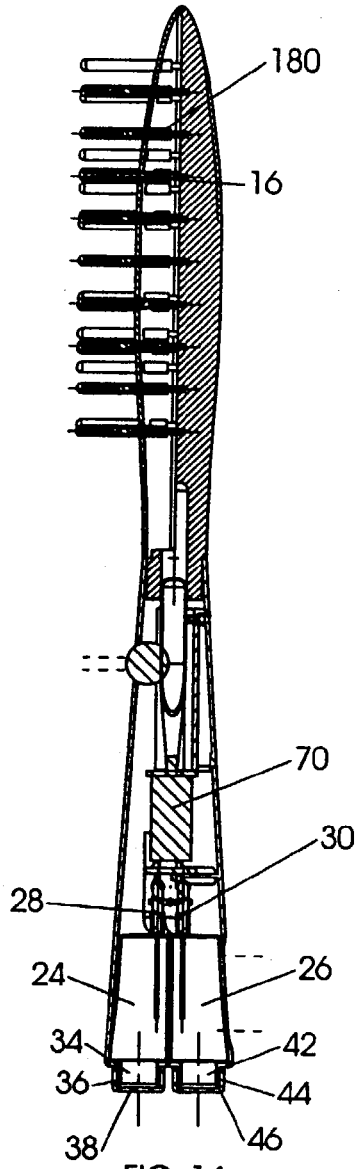
FIG. 14 is a side cross-sectional view of a dye applicator in accordance with the subject invention.

As shown in FIG. 12, the selector knob, step 170, allows the user to choose tasks: long hair, short hair, beard, mustache, and the like. The processor, as shown in step 172, then calculates the required proportions of dye-paste and catalyzer for the mix and activates the solenoid as discussed above. In step 174, the solenoid is powered and actuates the one way pumps extracting dye-paste and catalyzer from the containers to the fluid channels. In step 176, the dye-paste and catalyzer are pumped to the mixing chamber and the mixture is then pumped to the cavity in the brush head. In step 178, the bristles convey the required amount of catalyzed dye to the hair using capillary action. In one possible embodiment, the processor is programmed with the algorithm:

$$t=T_s \times k_t \tag{1}$$

wherein t is the time the solenoid receives power, $T_s$ is the period of the solenoid signal and $k_t$ is a correction factor. FIGS. 13 and 14 show how the bristles work by capillary action: the distal end 180 of each sponge sleeve extends far enough into head cavity 18 to be wetted with catalyzed dye.

Figure 15:
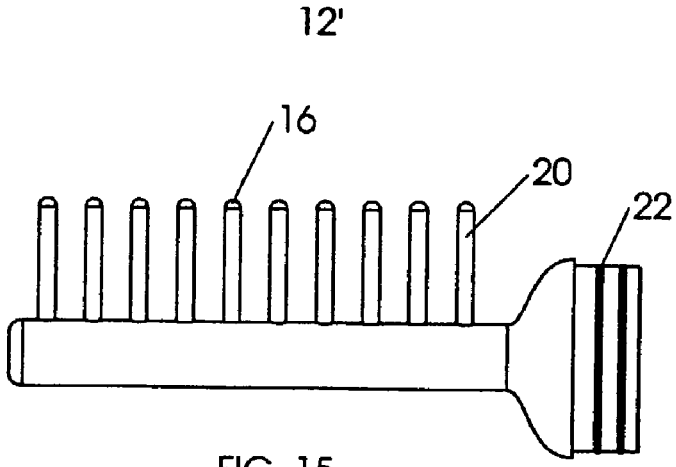
FIGS. 15 and 16 are schematic views showing an alternative comb head useful with the dye applicator of the subject invention.
Figure 16:
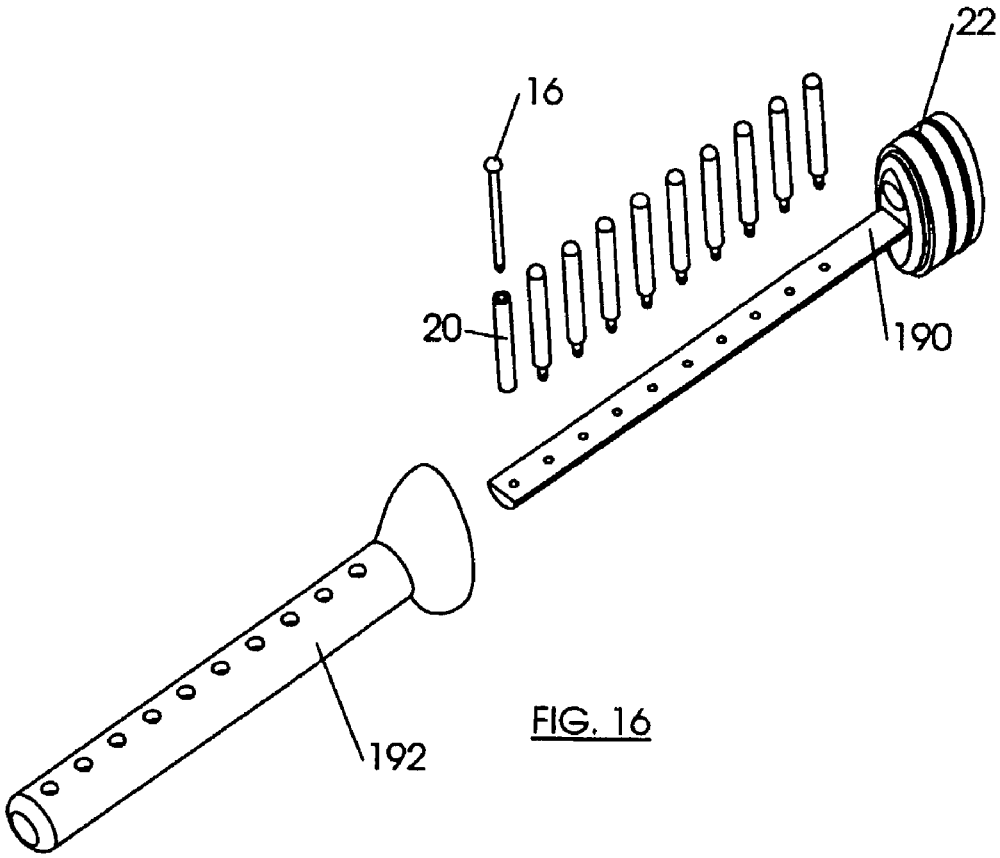
Figure 17:
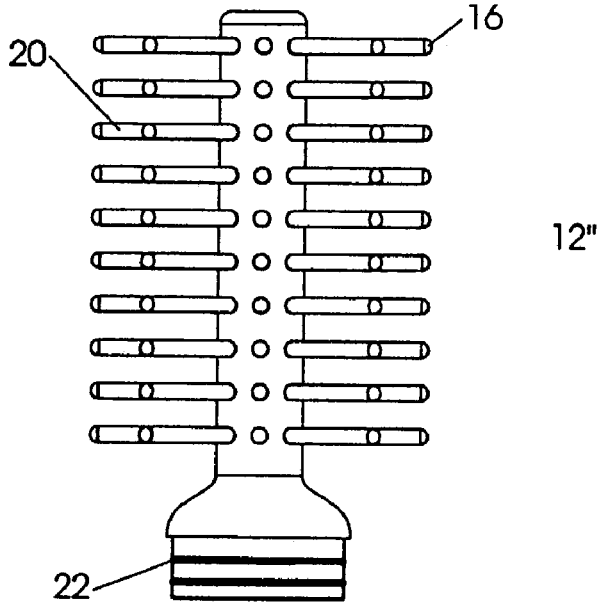
FIGS. 17–18 are schematic views showing another type of brush head useful in connection with the dye applicator of the subject invention.
Figure 18:
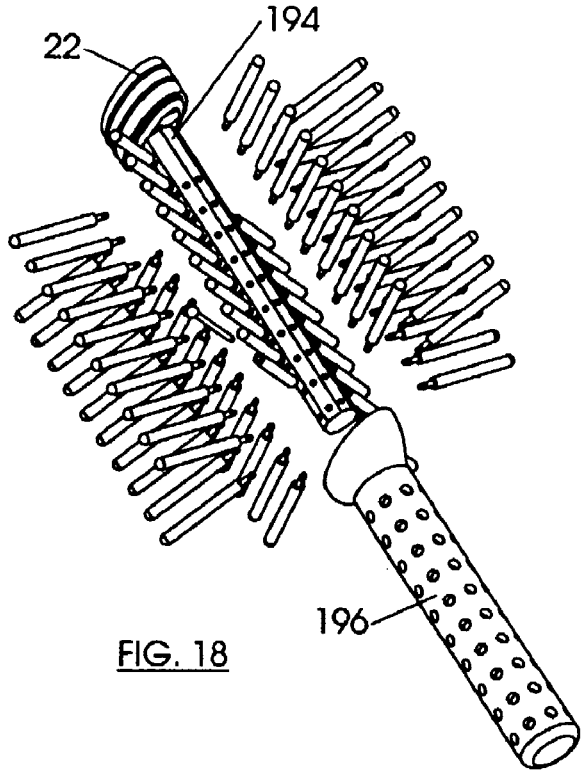

FIGS. 15–16 show an alternative round comb head 12' with a single row of bristles and tang 190 received in housing 192 whereas FIGS. 17–18 depict round brush head 12" with multiple spaced rows of bristles and tang 194 received in housing 196.

In this way, the novel applicator of the subject invention results in a more precise application of the dye and automatic pumping and mixing of the dye. The result is much higher precision application and less waste. The applicator of the subject invention is also easy to clean and can be used with a variety if different style heads. Applicator 10, FIG. 1, however, may be used as described herein in connection with compounds other than dyes, for example, shampoos and conditioners, scalp treatments, or the like both for humans or for pets. Or, modifications can be made by those skilled in the art to render the applicator discussed herein better suited to a particular application. Thus, the subject invention is not limited to an applicator specifically for dye compounds.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A dye applicator comprising:

a head with a cavity and a plurality of bristles in the form of pins each covered with a sponge sleeve extending into the cavity and moistened with a catalyzed dye in the cavity by capillary action; and a handle connected to the head, the handle including:

a first container for receiving a dye compound, a second container for receiving a catalyst compound, a pump for each container, a mixing chamber with a threaded compartment connected to the head cavity on one end, connected to the first container on the other end, and connected to the second container by a manifold for distributing the catalyst throughout the threaded compartment, a solenoid positioned to actuate both pumps to deliver the dye and the catalyst separately to the mixing chamber and to deliver the mixed catalyzed dye to the head cavity, a selector switch for selecting a task, and a processor, responsive to the selector switch and having an output connected to the solenoid, the processor configured to control the number of solenoid cycles based on the state of the selector for precise application of the dye based on the task selected.

2. The applicator of claim 1 in which the selector switch is on the handle and the first and second containers, the pumps, the mixing chamber, the solenoid, and the processor are all inside the handle.

3. The applicator of claim 1 further including a power source for the solenoid and the processor.

4. The applicator of claim 3 in which the power source is a pair of batteries in a compartment in the handle.

5. The applicator of claim 1 in which the handle is round.

6. The applicator of claim 1 in which the head is substantially flat and includes an array of bristles extending from one surface thereof.

7. The applicator of claim 1 in which the head is round and includes a single row of bristles.

8. The applicator of claim 1 in which the head is round and includes multiple spaced rows of bristles.

9. The applicator of claim 1 further including a one way valve on the handle for flushing the applicator.

10. The applicator of claim 1 in which the head is connected to the handle by a snap-fit to interchange different heads with the same handle.

11. The applicator of claim 1 in which the selector switch includes a potentiometer and a rolling knob for adjusting the voltage output by the potentiometer based on the position of the rolling knob.

12. An applicator comprising:

a head with a cavity and a plurality of bristles moistened with a substance in the cavity by capillary action; and a handle connected to the head, the handle including:

a selector mechanism for selecting a task, an actuator subsystem for delivering the substance to the cavity, and a processor responsive to the selector mechanism and having an output connected the actuator subsystem to control delivery of the substance to the head cavity based on the state of the selector mechanism.

13. The applicator of claim 12 in which the handle further includes first and second containers connected to a mixing chamber connected to the cavity in the head.

14. The applicator of claim 13 in which the actuator subsystem includes a pump for each container and a solenoid for activating both pumps.

15. The applicator of claim 14 in which the solenoid is connected to the processor and the processor is programmed to control the number of solenoid cycles based on the state of the selector mechanism.

16. The applicator of claim 13 in which the mixing chamber includes a threaded compartment connected to the head cavity on one end, connected to the first container on the other end, and connected to the second container by a manifold to distribute a compound in the second container throughout the threaded compartment.

17. The applicator of claim 12 in which the bristles include a pin and a sponge sleeve about the pin.

18. The applicator of claim 12 in which the head is substantially flat and includes an array of bristles on one surface thereof.

19. The applicator of claim 12 in which the head is round and includes a single row of bristles.

20. The applicator of claim 12 in which the head is round and includes multiple spaced rows of bristles.

21. The applicator of claim 12 further including a one way valve for flushing the applicator.

22. The applicator of claim 12 in which the head is connected to the handle via a snap-fit to interchange different heads with the same handle.

23. The applicator of claim 12 in which the selector switch includes a potentiometer and a rolling knob for adjusting the voltage output by the potentiometer based on the position of the rolling knob.

24. An applicator comprising:

a plurality of bristles moistened with a substance by capillary action;

a selector mechanism for selecting a task;

an actuator subsystem for delivering a substance to the bristles; and a control subsystem responsive to the selector mechanism and having an output connected to the actuator subsystem to control the delivery of the substance based on the state of the selector mechanism.

25. A fluidic mixing and delivery subsystem for an applicator, the subsystem comprising:

a first container for receiving a dye compound;

a second container for receiving a catalyst compound;

a mixing chamber connected to the first and second containers;

a pumping subsystem;

an actuator which activates the pumping subsystem to deliver dye and the catalyst to the mixing chamber for mixing;

a processor configured to control actuation cycles of the actuator; and a head with a reservoir therein connected to the mixing chamber and a plurality of highly porous members extending therein moistened with the mixed catalyzed dye by capillary action.

* * * * *